US005823130A

United States Patent [19]

Kreyn et al.

[11] Patent Number: 5,823,130

[45] Date of Patent: Oct. 20, 1998

[54] MULTI-HULL TANKER AND CONTAINER SHIP

[76] Inventors: Alex Z. Kreyn, 3147 Merlin Dr. North, Jasksonville, Fla. 32257; Zachary A. Kreyn, 3913 Mission Dr. #8, Jacksonville, Fla. 32217

[21] Appl. No.: 876,802

[22] Filed: Jun. 16, 1997

[51] Int. Cl.[6] ..... B63B 1/12

[52] U.S. Cl. ..... 114/61; 114/74 A

[58] Field of Search ..... 114/61, 74 R, 114/74 A

[56] References Cited

U.S. PATENT DOCUMENTS 4,440,103 4/1984 Lang ..... 114/61

4,763,596 8/1988 Yoshida ..... 114/61

*Primary Examiner*—Sherman Basinger

*Attorney, Agent, or Firm*—Thomas C. Saitta

[57] ABSTRACT

A multiple hull tanker vessel in the catamaran or trimaran style is provided with relatively narrow hulls containing vertically oriented, large volume, liquid storage tanks, the vertical tanks occupying the majority of the available area within the hulls, each hull having an upper portion which extends above the water line, a middle portion and a lower portion which remains below the water line, where the hull lower portion is extended in the lateral direction so as to be wider than the hull middle portion. The hull lower portion is preferably elliptical or ovoid in transverse cross-section and tapers at the bow and stern. The vertical storage tanks correspond in configuration to the hull configuration, and may extend laterally within the hull lower portion. The vessel may be provided with an upper deck surface to receive stacked cargo containers.

8 Claims, 4 Drawing Sheets

MULTI-HULL TANKER AND CONTAINER SHIP

BACKGROUND OF THE INVENTION

This invention relates generally to cargo vessels, more particularly to cargo vessels or tankers designed to transport relatively large volumes of liquid cargo, and even more particularly to combination vessels for transporting both large volumes of liquid cargo and a large number of cargo containers on an upper container deck. In particular, the invention relates to tanker vessels having multiple separate hulls connected above the water line by a bridging deck or platform, a hull design which is commonly known as a catamaran or trimaran. The bulk of the internal volume of the multiple hulls is provided as large volume storage tanks for liquid cargo, with each hull having a submerged laterally extended lower portion and a vertically oriented storage tank.

Large volume tanker vessels for transporting liquid cargo such as oil are well known, and generally comprise a deep, wide, U-shaped hull, preferably double walled for safety purposes and known in the industry as a double hull. While this configuration maximizes storage capacity in a given vessel, it is not the most efficient design for movement through the water. The deep, wide hull encounters tremendous resistance to forward travel caused by water friction beneath the surface and wave action at the surface. Similarly, vessels which transport large numbers of individual cargo containers stacked on an upper deck are known, usually referred to as container ships, and these also are configured with the deep, wide, U-shaped hull which is detrimental to efficient movement. Another problem almost always encountered with the typical tanker vessels and sometimes encountered with the container vessels is that there is often no return or outgoing cargo once the vessel has off-loaded its incoming cargo of liquid or containers, meaning that the return or voyage to the next loading port is made empty with no revenue to the ship owner.

It is an object of this invention to provide a novel and unique hull and storage tank configuration for a liquid cargo tanker vessel which addresses the problem of wave-making resistance by minimizing the hull surface area and width at the water surface and by streamlining the hull profile at and beneath the surface. It is a further object to provide such a tanker vessel which also addresses the problem of no return cargo by configuring it to receive and transport a large number of cargo containers stacked on the upper deck, thus allowing the vessel to operate as a tanker, a container ship, or a combination of the two on any given route. These objects are met by configuring the tanker vessel as a multiple hull vessel in the form of a catamaran or trimaran with a large open upper deck to receive containers, the multiple hulls being generally thin and elongated with laterally extended lower sections, preferably circular or elliptical in transverse cross-section, in order to provide a large volume area between the walls of each of the multiple hulls to contain generally vertically oriented liquid storage tanks.

SUMMARY OF THE INVENTION

The invention comprises in general a tanker vessel for carrying liquid cargo which has a plural number of separate hulls, each of which breaks the water surface line on both the port and starboard sides to create a catamaran or trimaran-type vessel, the multiple hulls being joined above the water surface by a bridging deck or platform member. The bridging deck member comprises of number of generally horizontal decks. Preferably, the upper surface is primarily adapted to receive stacked cargo containers of the type well known in the shipping industry, enabling the tanker vessel to also perform as a container vessel.

Each of the multiple hulls primarily comprises a large volume, generally vertically oriented, tank for the storage of liquids for transportation from one port to another, such that the large majority of the total available volume of each of the hulls is available for liquid storage. The lower portion or bottom of each of the hulls is laterally extended in transverse cross-section relative to the portion of the hull above it, i.e., the lower portion is of significantly greater width than the adjacent middle portion of the hull above the lower portion. In this manner, the hulls have a generally inverted T-shape when taken in transverse cross-section. The laterally extended lower portion may be elliptical, ovoid, circular or other similar profiles in cross-section, while the middle and upper portion of the hull will have generally vertical walls or walls angled slightly outward, which may be straight or curved. Each of the vertical storage tanks may extend completely to the bottom of the hull or may terminate a relatively short distance above the bottom. The vertical storage tanks may also be configured to expand laterally within the lower portion of the hulls to increase storage capacity. Alternatively, separate and independent, generally laterally extended storage tanks may be provided within the lower portion of the hulls.

The vertical walls of the multiple hulls are preferably generally parallel or angled narrowly in divergence, in contrast to typical wide U- or V-shaped hulls encountered in single hull vessels or standard catamaran designs. In this manner, even when a large volume of liquid is being transported by the vessel, the multiple hulls will present relatively small widths at the water line, thereby reducing resistance caused by wave action. The dimensions and configuration of the hulls and tanks may vary in the longitudinal direction for improved passage through the water. For example, the forward or aft portions may be tapered vertically and laterally to present a less blunt profile and to improve fluid flow along the longitudinal hull walls. The laterally extended portion of the lower hulls will remain below the water line under load or no-load conditions, while the vertical storage tanks will extend above and below the water line under all conditions.

The hulls will also include ballast chambers in the laterally extended lower portions which can be filled with sea water or the like to properly position the draft of the vessel relative to the water line to provide the thinnest optimal hull width at the surface for a given load. Additionally, in the situation where the vessel is also constructed with above water cargo platform means, and especially in the situation where the vessel is a combination tanker and container ship having a large upper platform to receive stacks of cargo containers, the ballast tanks when filled will counter the effects of the relatively high stacks of containers above the platform by lowering the overall center of gravity of the vessel to prevent excessive pitch or roll.

DESCRIPTION OF THE INVENTION

Figure 1:
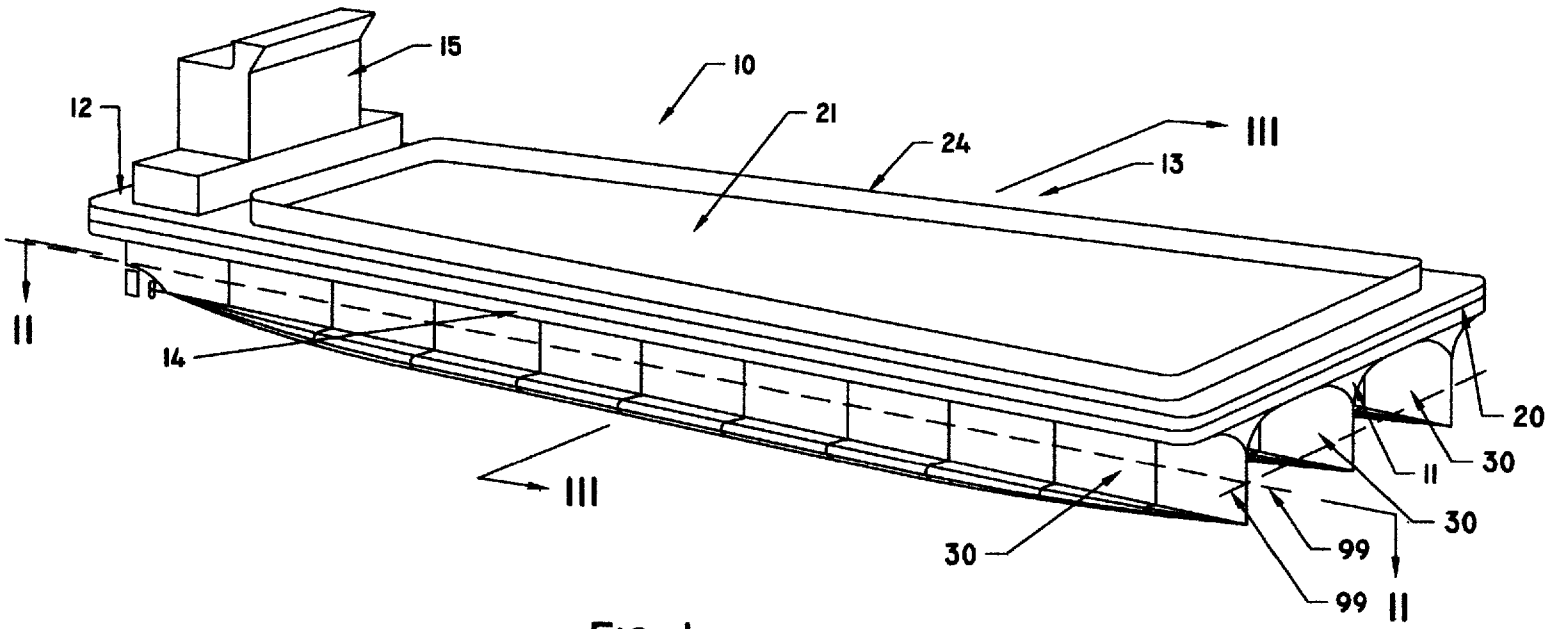
FIG. 1 is a perspective view of a combination tanker and container ship according to the preferred embodiment of the invention.

With reference to the accompanying drawing figures, the invention will now be described in detail with regard for the best mode and preferred embodiment. The drawing figures are not shown to scale, the various walls being shown in greater width than would be required in an actual vessel. In general, the invention is a tanker ship or vessel constructed to carry relatively large amounts of liquid cargo, for example from 50 to 300 thousand tons of crude oil or the like, from one port to another in a faster and more efficient manner than currently found in the shipping industry. The tanker vessel is preferably a combination tanker and container ship, containers being well known in the industry and typically consisting of large sealed rectangular metal receptacles which can be transported to a vessel on wheeled motor vehicles, such as trucks or trains, lifted by cranes and vertically stacked on a large open upper deck of the seagoing vessel, and then removed from the vessel and placed back onto land transports at the destination port. The vessel of the invention has multiple separate hulls in a catamaran or trimaran configuration which are connected above the water line by a bridging deck member, such that each hull depends independently beneath the deck member and into the water. The liquid storage tanks of the vessel are contained within each of the hulls and are predominantly vertical in orientation and preferably have a lower laterally extended portion, with the hull configurations having a generally inverted T-shaped when taken in transverse cross-section, the vertical walls of the hulls being generally parallel or upwardly diverging in a relatively small amount. The vertical configuration of the storage tanks within the hulls provides a streamlined and relatively thin profile at the water line to reduce resistance from waves.

Figure 2:
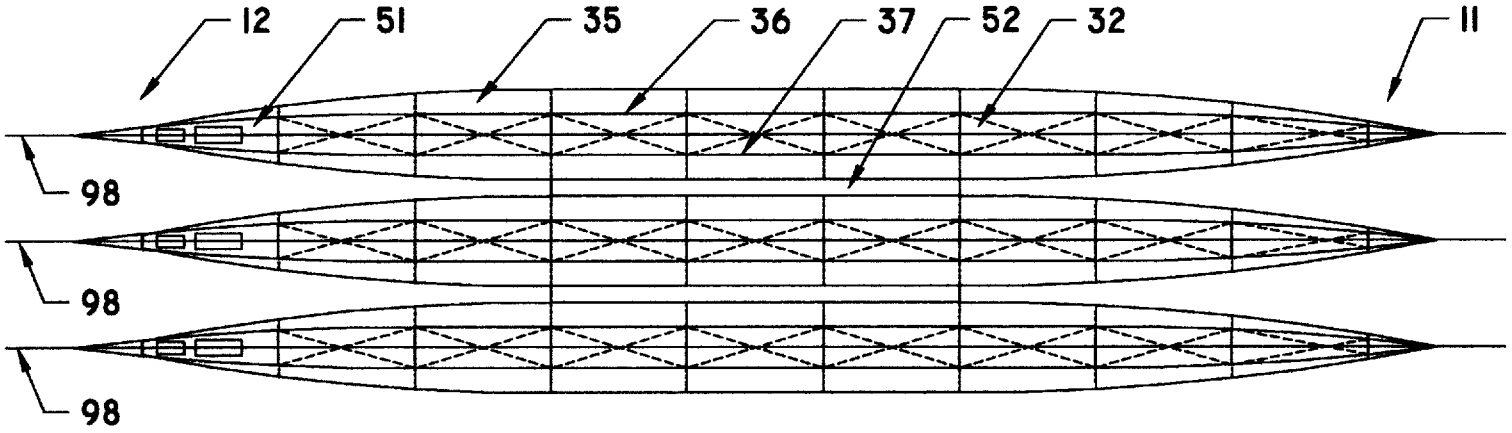
FIG. 2 is a vertical cross-sectional view taken along line II—II of FIG. 1, showing the hulls configuration and structural profile.
Figure 3:
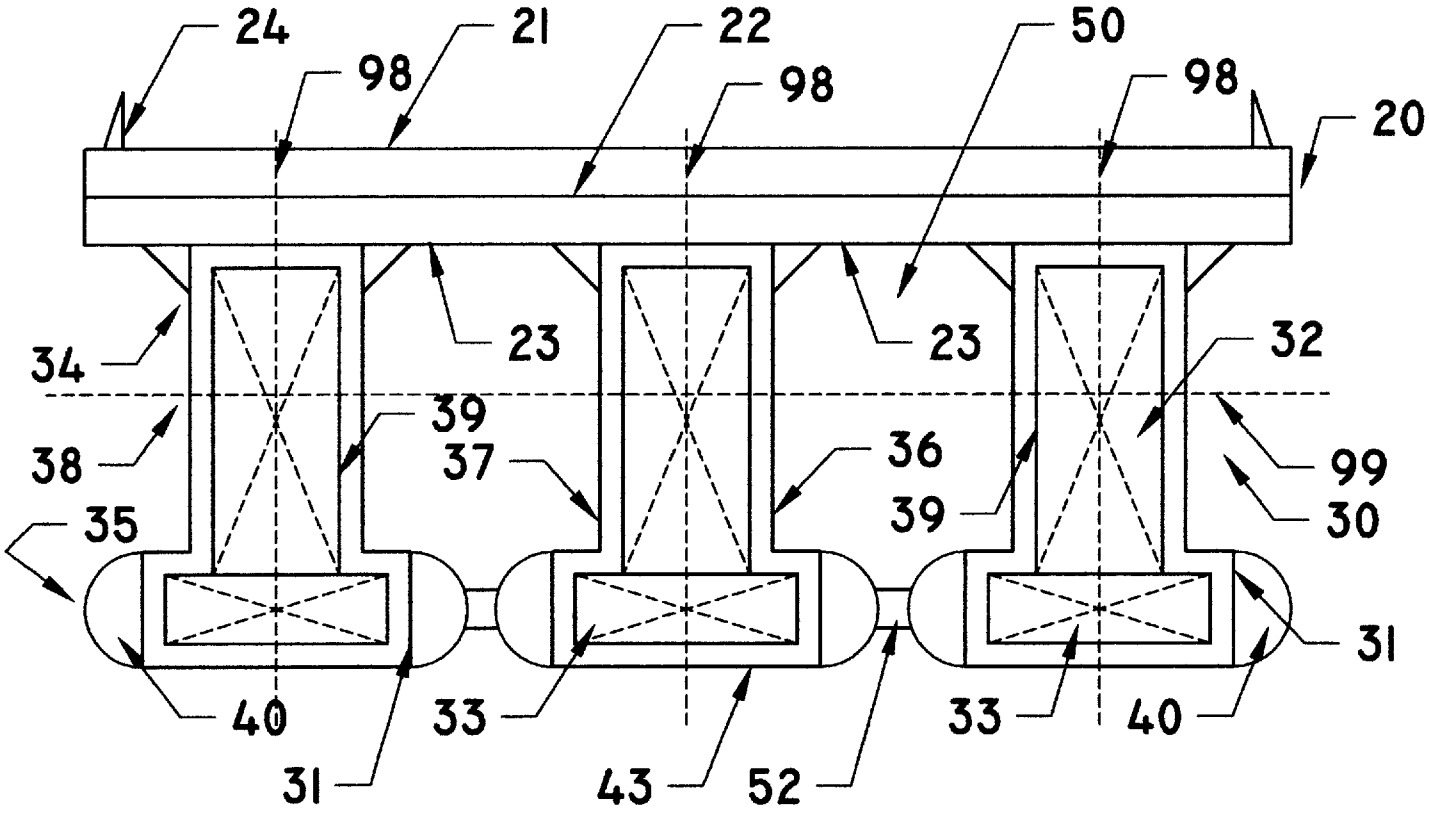
FIG. 3 is a transverse cross-sectional view taken along line III—III of FIG. 1, showing a midships section.
Figure 5:
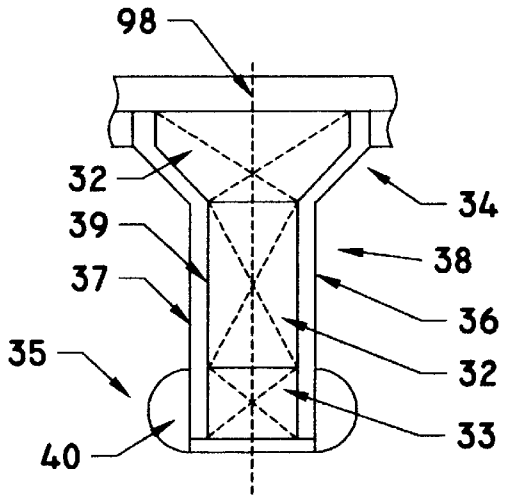

With reference now primarily to FIGS. 1, 2 and 3, the invention is shown to comprise in general a vessel or ship 10 having a bow 11, stern 12, port side 13, starboard side 14 and operations bridge 15. The major portion of the vessel 10 above the water surface line 99 consists of a bridging deck member 20, which comprises an upper surface 21, possibly having a peripheral retaining wall 24, interior compartments or levels 22 and a bottom surface 23 which remains above the water line 99. The bridging deck member 20 contains the operational components for the ship underneath the upper surface 21, such as manifolds, pipes, and other apparati for pumping oil, and connects the plural hulls 30 to create the catamaran or trimaran multi-hull configuration.

Figure 4:
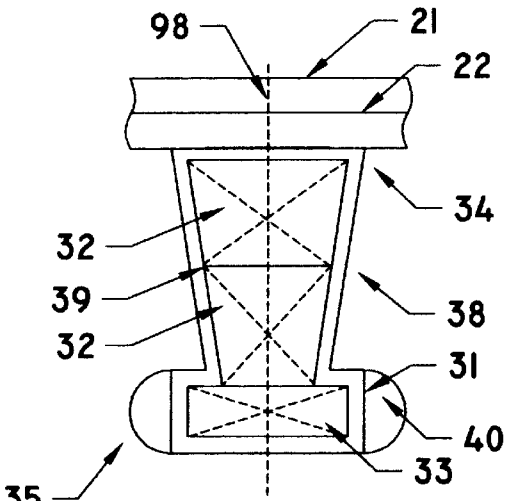
FIGS. 4(*a*)–(*d*) are transverse cross-sectional views of alternative configurations of an individual hull.
Figure 7:
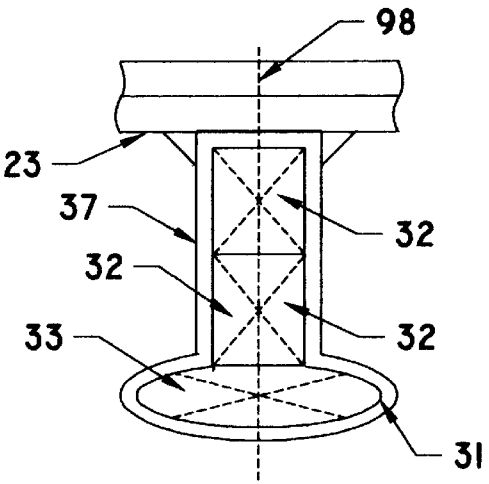
Figure 6:
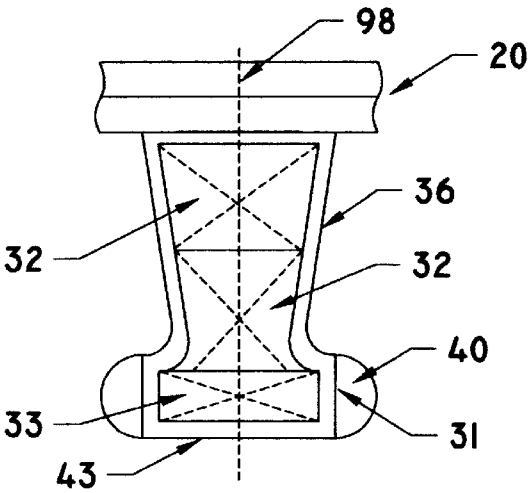

Depending from the bottom surface 23 of the bridging deck member 20 are plural or multiple hulls 30. The two outermost hulls 30 are preferably positioned relatively far apart in the transverse direction of the vessel 10 so as to be located relatively near the port and starboard sides 13 and 14 for improved stability. Where more than two hulls 30 are present, all the hulls 30 are preferably equidistantly spaced in the transverse direction. Each of the hulls 30 generally comprises double hull walls 31 and 39, a port-side outer surface 36, a starboard-side outer surface 37, a bottom surface 43, a hull upper portion 34, a hull middle portion 38 and a hull lower portion 35. The double hull walls 31 and 39 are mandated by law to better prevent loss of liquid cargo into the ocean from collision or the like. Disposed within each of the hulls 30 is a generally vertically oriented liquid storage tank 32 which occupies the vast majority of the total volume of each of the hulls 30. The vertical storage tanks 32 preferably extend the entire vertical distance of the hulls 30, and preferably generally correspond in configuration to the configuration of the hulls 30 to maximize capacity. The vertical storage tanks 32 may have straight, angled or curved walls, and may be divided into separate compartments, as shown in FIGS. 2, 3 and 4.

The upper portion 34 of each of the hulls 30 extends from beneath the deck member 20 toward the water line 99, the middle portion 38 of each of the hulls 30 passes through the water line 99, and the lower portion 35 of each of the hulls 30 remains below the water line 99. Portions of both the port-side outer surface 36 and the starboard-side outer surface 37 of each hull 30 extend above the water line 99, thereby producing a vessel configuration commonly referred to as a catamaran or trimaran, depending on whether two or three hulls 30 are present. The upper portion 34 of adjacent hulls 30 may directly abut each other above the water line 99, with the port-side surface 36 of one such hull 30 meeting the starboard-side surface 37 of the other such hull 30. Alternatively, the adjacent hulls 30 may not be abutting but instead connected by a generally horizontal bottom surface 23 of the bridging deck member 20, as shown in FIG. 3.

The port-side outer surface 36 and starboard-side outer surface 37 of each hull 30 are generally vertical and occupy the middle hull portion 38. The port-side outer surface 36 and starboard-side outer surface 37 of each hull 30 are preferably parallel, as shown in FIG. 3, or narrowly diverging in the upward direction, as shown in FIGS. 4(*a*) and 4(*c*). The vertical surfaces 36 and 37 may be linear or curved, as shown in FIGS. 4(*a*)–(*d*). Whatever the particular embodiment for the vertical surfaces 36 and 37, the hulls 30 are not configured in the well known wide U-shape. The middle hull portion 38 passes through the water line 99 at different levels depending on the cargo load and ballast, and it is imperative that the multiple hulls 30 of the vessel 10 each present a small cross-sectional configuration to reduce drag caused by wave action, which can be significant at high speed. The hull upper portion 34 of each hull 30 may expand outwardly to maximize capacity and strength, as the hull upper portions 34 remain above the water line 99 under all load conditions.

Each hull lower portion 35 is extended or expanded in the lateral or transverse cross-sectional direction relative to the hull middle portion 38 above it, such that the hull lower portion 35 is much wider than the hull middle portion 38. The hull lower portions 35 may be connected to adjacent hull lower portions 38 with a submerged bridging member 52 on part or over the full length of the hull. The hull lower portion 35 may be configured with an elliptical, ovoid, circular, rectangular or other cross-sectional profile, as shown in FIGS. 4(*a*)–(*d*). In general, the combination of the hull upper, middle and lower portions 34, 38 and 35 defines a hull 30 having a generally inverted T-shape when taken in cross-section.

The vertical storage tanks 32 extend above and below the water line 99, such that a portion of the liquid cargo is transported below the surface of the water and a portion above. The vertical storage tanks 32 extend substantially the full longitudinal or bow-to-stern distance of the hulls 30. The vertical storage tanks 32 are preferably configured to generally correspond to the particular shape of the hull 30 in order to maximize storage capacity. Each of the vertical storage tanks 32 has a height greater than its width at substantially every point measured on the hull longitudinal vertical center plane 98, such that its vertical distance generally always exceeds its lateral or transverse distance. This results in a relatively streamlined overall configuration which minimizes resistance to the forward motion of the vessel 10. Additionally, the hulls 30 can be tapered or narrowed in the vertical and the lateral direction at the bow 11 or stern 12 to provide smaller surface area and a generally pointed profile, as shown in FIG. 2. The provision of vertical tanks 32 within relatively narrow multiple hulls 30 also results in the formation of a flow passage 50 between each adjacent hull 30, allowing water or ice to pass more easily between the adjacent hulls 30.

Each of the vertical storage tanks 32 may be mounted above or divided to create a separate laterally extended storage tank 33 whose width is greater than its height at substantially any point taken on the hull longitudinal center line, such that its cross-sectional or transverse distance generally always exceeds its vertical distance, as seen in FIGS. 3, 4(*a*), 4(*c*) and 4(*d*). Alternatively, the vertical storage tank 32 itself may be configured to broaden laterally in the area of the hull lower portion 35, thus taking on a general T-shaped configuration similar to the overall hull configuration. Like the vertical storage tanks 32, the lateral storage tanks 33 preferably extend substantially the full longitudinal distance of the hulls 30. The provision of lateral storage tanks 33 allows an even larger portion of the liquid cargo to be stored below the water line 99 during transport than is possible with only vertical storage tanks 32.

The configurations for the vertical storage tanks 32 and the lateral storage tanks 33 may vary, as shown in FIGS. 3 and 4. As shown in FIGS. 3, 4(*b*) and 4(*d*), the preferred configuration for vertical storage tanks 32 comprises generally straight vertical walls, although the walls may be slightly outwardly angled or curved as shown in FIGS. 4(*a*) and 4(*c*). Likewise, the configuration for the lateral storage tanks 33 may vary from rectangular to oblong to ellipsoid to circular. Preferably, each of the hulls 30 has an engine room 51, as shown in FIG. 2, which results in improved maneuverability as steering may be accomplished by varying the thrust of individual hulls.

Ballast chambers 40 capable of receiving and discharging liquid such as sea water are preferably positioned within the lower portions 35 of hulls 30. The ballast chambers 40 are used to properly adjust the draft of the vessel depending on the load amount so that the most optimum, i.e., narrowest, transverse hull profile is presented for any given load or sailing conditions. When the vessel 10 has no or a small amount of liquid cargo, it may be necessary to fill the ballast chambers 40 partially or fully to provide the correct draft for the vessel 10. This is especially true in the circumstance where the upper surface 21 of the bridging deck member 20 is loaded with cargo containers, since it will be necessary to lower the center of gravity of the vessel 10 to prevent excessive pitch or roll. The ballast chambers 40 also provide an additional safety barrier to protect the tanks 32 and 33 in the hull lower portion 38.

As described above, large volume tanker vessels 10 capable of carrying large liquid cargo loads can be constructed with a multiple hull design to increase operating efficiency. The multiple hull vessels 10 can be constructed with an open upper surface 21 to receive stacked cargo containers. For example, a trimaran-type 50,000 ton tanker may be constructed having approximate dimensions of 230 meters in length with hulls extending 20 meters in depth and lower hull portions 35 of maximum beam width of 19 meters. Approximately one quarter of the liquid cargo would be carried in the horizontal tanks 33 with the remainder in the vertical tanks 32. For a 300,000 ton tanker, the length would be approximately 480 meters, with hulls extending 27 meters in depth and lower hull portions 35 of maximum beam width of 35 meters. The liquid cargo would be split relatively evenly between the horizontal tanks 33 and vertical tanks 32.

It is understood that equivalents and substitutions of certain elements and components described above may be obvious to those skilled in the art. The true scope and definition of the invention therefore is to be as set forth in the following claims.

We claim:

1. A combination tanker and container transport vessel having plural separate hulls connected above the water line by a bridging deck member having an upper surface structured to receive stacked cargo containers, each of said hulls comprised of double walls having an upper portion above the water line, a middle portion passing through the water line, a lower portion below the water line extended laterally such that said hull lower portion is wider than said hull middle portion, a port-side outer surface, a portion of which is above the water line, a starboard-side outer surface, a portion of which is above the water line, a longitudinal length, a longitudinal center plane, a height, a volume and a lateral width, each of said hulls comprised mainly of a vertical storage tank divided into multiple compartments for liquid cargo occupying the majority of the hull volume and extending generally the full longitudinal length of each of said hulls, each said vertical storage tank having a lateral distance and a vertical distance, where the vertical distance of each said vertical storage tank exceeds the lateral distance of each said vertical storage tank at substantially every point along the hull longitudinal center plane, and where each said vertical storage tank extends above and below the water line, said hull lower portion further comprising ballast tanks to control the draft of the vessel under all load conditions and to lower the center of gravity of said vessel when said upper surface of said bridging deck is loaded with cargo containers and said vertical storage tanks are empty, whereby said vessel is able to operate independently as either a tanker or a container ship.

2. The vessel of claim 1, where said port side outer surface of said hull middle portion is parallel to said starboard side outer surface of said hull middle portion.

3. The vessel of claim 1, where said hull middle portion angles slightly outward from said hull lower portion to said hull upper portion.

4. The vessel of claim 1, where said hull middle portion curves slightly outward from said hull lower portion to said hull upper portion.

5. The vessel of claim 1, where said vertical storage tanks expand laterally within said hull lower portion.

6. The vessel of claim 1, further comprising a laterally extended storage tank within said lower hull portion.

7. The vessel of claim 1, where said hull lower portions are elliptical in cross-section.

8. The vessel of claim 1, where said hulls taper in the transverse direction at the bow and stern.

* * * * *